US005970535A

United States Patent [19]

Wayne

[11] Patent Number: 5,970,535

[45] Date of Patent: Oct. 26, 1999

[54] ADJUSTABLE SHOWER-ENCLOSURE SUPPORT APPARATUS

[76] Inventor: Ramon Wayne, 33-635 Richmond Rd., Ottawa, K2A OG6, Canada

[21] Appl. No.: 08/953,720

[22] Filed: Oct. 17, 1997

[51] Int. Cl.[6] ..... A47K 3/024

[52] U.S. Cl. ..... 4/576.1

[58] Field of Search ..... 4/573.1, 576.1, 4/577.1, 604, 611, 571.1, 254

[56] References Cited

U.S. PATENT DOCUMENTS

| | | | |
|---|---|---|---|
| 2,817,095 | 12/1957 | Jefferies | 4/576.1 |
| 3,568,220 | 3/1971 | Dees | 4/576.1 |
| 3,990,120 | 11/1976 | Rankin | 4/573.1 |
| 4,498,204 | 2/1985 | Warner | 4/571.1 X |

*Primary Examiner*—Charles E. Phillips

*Attorney, Agent, or Firm*—Sixbey, Friedman, Leedom Ferguson, P.C.; Daniel W. Sixbey; Jeffrey L. Costellia

[57] ABSTRACT

The invention relates to an adjustable, wall-mounted, shower-enclosure, support apparatus, adapted to provide, when required, enhanced protection against injury, through loss of balance, to a bather, using the shower in a bathtub-shower combination unit or, alternatively, a separate shower stall. A bather who loses balance, for any reason, while taking a shower, is liable to fall in any direction. Yet, wall-mounted grab-bars in a shower-enclosure, generally, provide protection against that risk in only one or two directions. To overcome that deficiency, the invention provides for an apparatus which incorporates a body-encompassing frame member that can surround the bather at a chosen height, when required, and thereby supply, in all directions within a horizontal plane, a reliable means of support which can be seized in an emergency or which can break a fall under certain circumstances, when the support cannot be used as intended.

9 Claims, 8 Drawing Sheets

ADJUSTABLE SHOWER-ENCLOSURE SUPPORT APPARATUS

BACKGROUND TO THE INVENTION

The present invention relates generally to a bathroom safety device and specifically to a wall-mounted, shower-enclosure, support apparatus, adapted to provide, when required, enhanced protection against injury, through loss of balance, to a bather using the shower in a bathtub-shower combination unit or, alternatively, a separate shower stall.

It is common knowledge that the bathtub can be a hazardous place for all who use it and especially when it is utilized for the purpose of showering. The bathtub bottom surface, normally slippery when wet, can become even more so from a residue of soap scum, while a bathtub mat, if present, can be equally dangerous if it is worn, improperly secured to that bottom surface or also coated with soap scum. Under such circumstances, if a bather, standing in the bathtub to take a shower, should make a sudden movement to catch a falling bar of soap, tube of shampoo or wash cloth, for example, or become disoriented for any reason, a momentary loss of balance could occur, which could lead to an injury-causing fall into or out of the bathtub.

The industry has responded to that risk by offering wall-mounted grab-bars, which are expected to be grasped suddenly for support by a bather, faced with an abrupt loss of balance while standing, showering or shifting position in a bathtub. Such bars, however, generally provide protection in only one or two directions, whereas a bather, who loses balance, is liable to fall in any direction. In addition, a bather, in the act of slipping or falling, is most likely to be governed by instinct and to reach for assistance, using a "writing" or "tool" hand, which may not coincide, in all cases, with the position of the nearest grab-bar, at the time of distress. As a result, a grab-bar which could save one bather, could be useless for another in the same situation because of the orientation of that bather.

Though the grab-bar can be an effective safeguard against injury to a bather during an emergency, if the bather is facing in the "right" direction at the moment of instability and is able to seize the bar with a free hand to prevent slipping or falling, therefore, it is clear that it does not provide any help if those conditions are absent or if the bather should become disoriented and not know which way to turn for assistance. In other words, grab-bar installations generally leave, for one reason or another, a protection gap of variable extent, which can result in serious injury or even death, if not closed. That is because, aside from a rigid, tub enclosure, which might provide some assistance under certain conditions, normally, there is no other means present to prevent or break a fall into or out of the bathtub. The risk, though somewhat reduced, also exists in a separate shower stall having an outward-opening door.

Since unsteadiness or dizziness is most often associated with advanced age, the risk of a fall while showering, may be greatest among senior citizens. It is also a real threat, however, for the handicapped, for pregnant women, and for the young, in general, if the previously-cited tub conditions exist or there is a momentary loss of concentration while enjoying the pleasure of showering, if there is pre-occupation with other matters, if soap or water gets in the bather's eyes or, if excessive use of alcohol or narcotics causes disorientation or a loss of balance.

Given the limited usefulness of conventional grab-bar installations as a means of preventing, or reducing the severity of, injuries in the bathtub, therefore, there is clearly a need for a better alternative, which not only can be more effective for those purposes, under all of the circumstances likely to be encountered by a bather using the shower in a bathtub-shower combination unit or a separate shower stall, but also possesses characteristics which would make it acceptable to the average consumer, as a worthy addition to the bathroom. As far as can be determined at this time, there appears to be no evidence that prior art has provided such an alternative.

Accordingly, it is the principal object of the present invention to provide a device, which eliminates the protection gap associated with conventional grab-bar installations, by supplying, when required, protection to a showering bather in all directions within a horizontal plane.

Another object of the present invention is to provide a device which is safe and reliable to use.

Another object of the present invention is to provide a device which is easy to operate and adjust.

Another object of the present invention is to provide a device which is adaptable to users of varying physical height.

Another object of the present invention is to provide a device which is useful in both the operating and storage modes.

Another object of the present invention is to provide a device which does not interfere with the operation, or reduce the effectiveness, of a shower curtain or rigid tub enclosure.

Another object of the present invention is to provide a device which can be by-passed, if desired by the bather, and not interfere with regular bathing practices, when not in use.

Another object of the present invention is to provide a device which can be easily and inexpensively retrofitted to existing shower-enclosures or readily installed during new construction or a manufacturing process.

Another object of the present invention is to provide a device which does not inhibit nor interfere with normal bathtub or shower stall cleaning procedures.

Another object of the present invention is to provide a device which is capable of being colored in order to coordinate with existing bathroom decor.

SUMMARY OF THE INVENTION

The present invention provides a new and highly beneficial device, which can reduce the current risk and the severity of potential injury to a bather experiencing a loss of balance, while showering in a bathtub-shower combination unit or a separate shower stall. As described below, this has been accomplished by the development of a wall-mounted apparatus, whose principal component can surround the bather at a chosen height, when required, and thereby provide, in all directions within a horizontal plane, a reliable means of support which can be seized in an emergency or which can break a fall under certain circumstances, when the support cannot be used as intended. Adding to its appeal, the apparatus can be easily and inexpensively retrofitted in existing shower enclosures, or incorporated into new ones during construction or manufacture, is easy to operate and adjust, is compatible with users of varying height, can be by-passed by the bather, if desired, and does not interfere with regular bathing or cleaning practices, when not in use. It also provides limited, but useful, protection in the storage mode.

As suggested above, the new apparatus can be used most advantageously in a bathtub-shower combination unit characterized by a front wall, on which are found the shower head, hot and cold water controls and faucet, a rear wall at the opposite end of the bathtub, a side wall which connects the front and rear walls and on which are often found attached, a soap dish and grab-bar, and a moveable and flexible shower curtain, attached to rings on a rod linking the front and rear walls opposite to the side wall, or a set of sliding glass or plastic panels in a frame that connects the front and rear walls, in place of the shower curtain. In such an environment, a bather who loses balance while using the shower, is most vulnerable to injury in a fall toward the shower curtain or the rear wall but is also susceptible in other directions, if a grab-bar is absent or installed only on the side wall or the wrong wall for instinctive use, or the loss of balance occurs too quickly for the bar to be utilized as intended. In a separate shower stall, an outward-opening door can add to those risks.

Accordingly, the invention introduces a wall-mounted, shower-enclosure, support apparatus, which comprises

- a frame member, having a shape that is compatible with that of the shower-enclosure, dimensions that allow it to surround and protect a bather comfortably during showering, and a pair of radial keys that enable it to be supported securely in a horizontal plane by a complementary hinge member, when required;
- a complementary hinge member, which can connect the frame member indirectly to the side wall or other mounting surface, in a releasable and pivotal manner, and support that member in a horizontal plane, when required;
- a storage cradle member, which can secure the frame member, in a releasable manner, in a vertical storage position, when required, while that member is still engaged with the hinge member, and which enables the frame member to be used, in the storage position, for safe support by the bather, upon entering and leaving the shower-enclosure; and
- optional means for adjusting the operational and storage height of the apparatus in general, and the frame member in particular, within the shower-enclosure, that consist of a tubular, upstanding member, that connects the hinge and storage cradle members to each other;
- a wall-mounted, partly-open, guide member, within which the upstanding member can slide up and down; and
- stop means, in the form of a retractable pin, for fixing, through one of a series of apertures in the upstanding member, the desired position of that member within the guide member, when required.

In the description and drawings that follow, three embodiments of the invention are presented and illustrated, partially and in full. The first, which represents the basic version of the apparatus, employs a generally rectangular frame member that is intended for use in a bathtub-shower combination unit, as depicted, in full, in FIGS. 1 and 2. The second, which represents a more versatile version of the apparatus, by incorporating the height adjustment means, also employs a generally rectangular frame member, for use in a bathtub-shower combination unit, and is depicted, in full, in FIG. 17. The third embodiment, which is intended for use in a corner shower stall of irregular shape, employs, in the adjustable version of the apparatus, a frame member that has been modified to make it compatible with the shape of that stall, as depicted, in full, in FIG. 18.

DETAILED DESCRIPTION OF THE PREFERRED EMBODIMENTS

Figure 1:
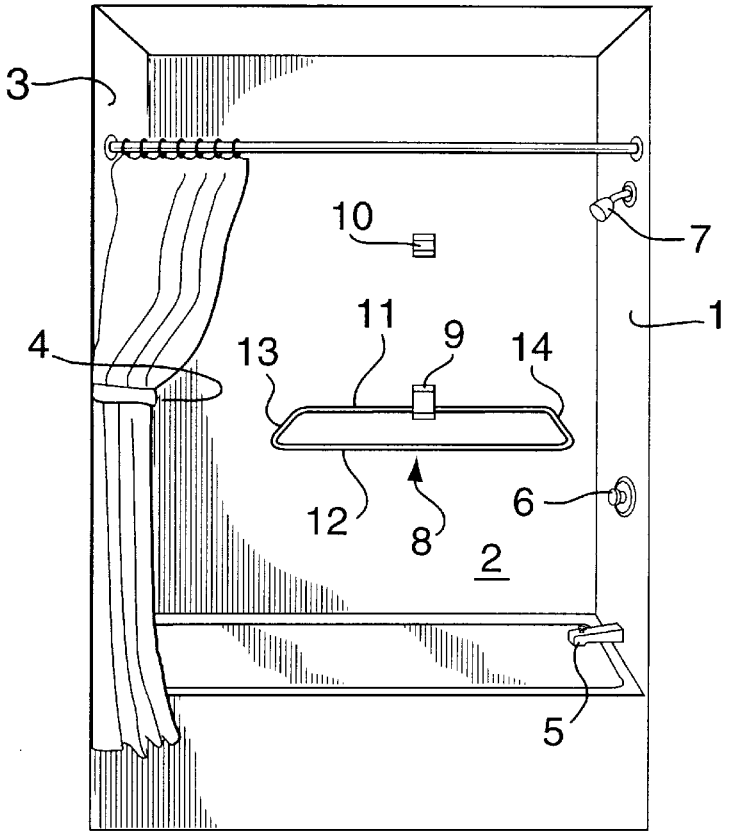
FIG. 1 is a perspective view of the shower-enclosure, support apparatus, according to the first embodiment of the invention, displayed in the operational position, in a bathtub-shower combination unit.
Figure 2:
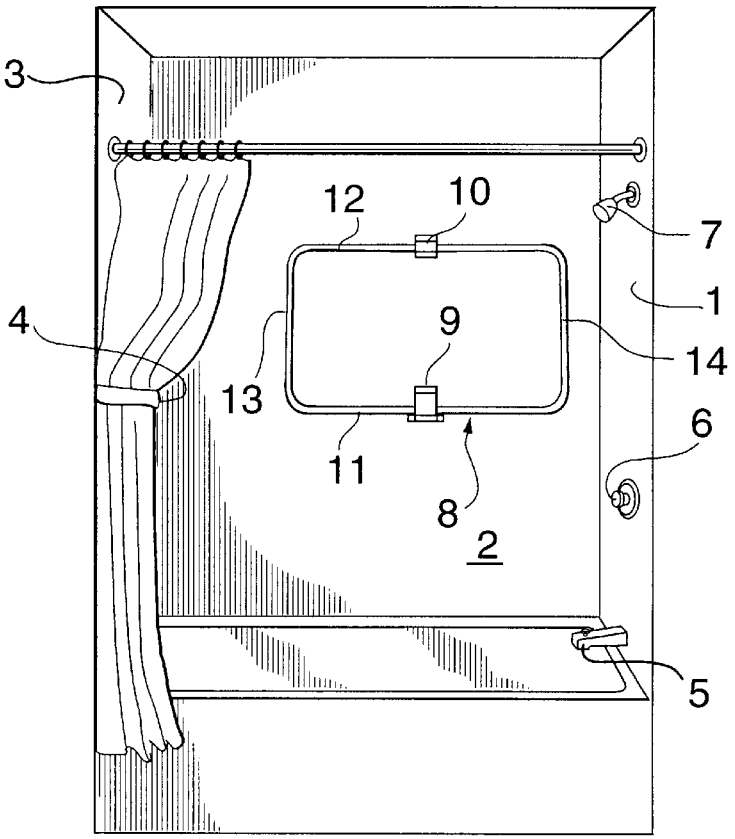
FIG. 2 is a perspective view of the shower-enclosure, support apparatus, according to the first embodiment of the invention, displayed in the storage position, in a bathtub-shower combination unit.

As illustrated in FIGS. 1 and 2, the invention can be used most advantageously in the shower-enclosure of a bathtub-shower combination unit employing a shower curtain. In such units, the shower-enclosure can be characterized as having a front wall 1, a side wall 2, a rear wall 3, a moveable shower curtain 4, a faucet 5, a hot and cold water control 6 and a shower head 7.

As shown in FIGS. 1 and 2, the shower-enclosure, support apparatus of the present invention comprises, in the first preferred embodiment, a generally rectangular frame member 8, a means for releasably and pivotally connecting the frame member 8, indirectly, to the side wall 2 and supporting it in a horizontal plane, when required, that consists of a hinge member 9, and means for releasably securing frame member 8 in a vertical storage position, when required, that comprises a storage cradle member 10.

The frame member 8, which is formed mainly from round, rigid, metal tube and has an exterior width, that is slightly less than the distance between side wall 2 and shower curtain 4, and an exterior length that is approximately 50% greater than its exterior width, is considered large enough to surround the bather when in use and to provide ample room for movement within the frame. As indicated in FIGS. 1, 2 and 3, the frame member 8 further has a first side 11 and an opposite, second side 12, a first end 13 extending between the first side 11 and the second side 12, and a second end 14 extending between the first side 11 and the second side 12, opposite to the first end 13.

Figure 3:
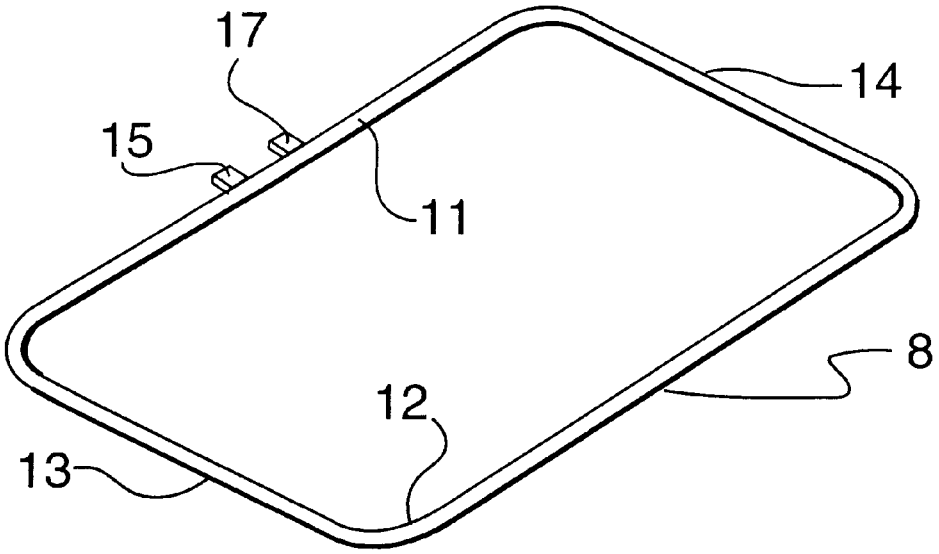
FIG. 3 is an isometric view of the frame member of the shower-enclosure, support apparatus, according to the first embodiment of the invention, showing the positions and relative size of the two, radial key, components.
Figure 4:
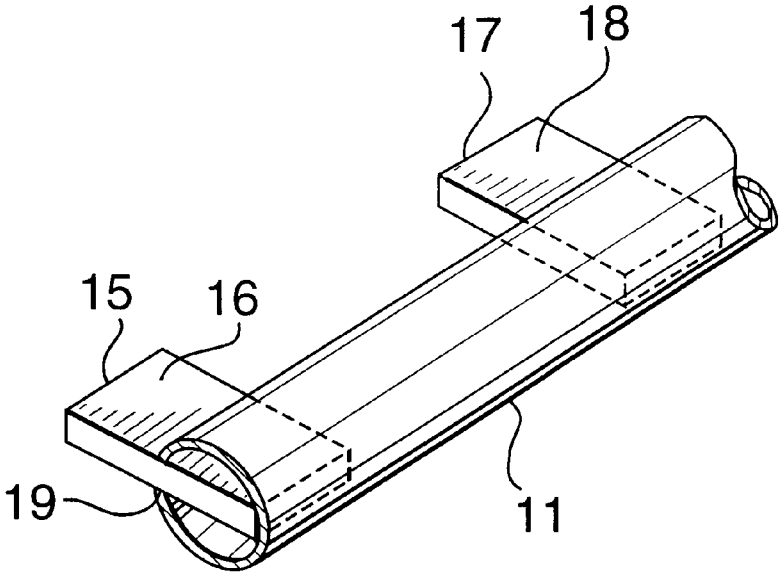
FIG. 4 is an isometric view of the engagement section of the first side of the frame member of the apparatus, according to the first embodiment of the invention, showing the fit of the radial key, components within the tubular frame member.

Attached to the first side 11, as illustrated in FIGS. 2, 3 and 4, are two outward protruding elements, a first, rectangular key, component 15, having an upper surface 16, as shown in FIG. 4, and a second, rectangular key, component 17, having an upper surface 18, as also shown in FIG. 4. As illustrated in FIG. 4, with respect to key component 15, each key component penetrates the interior of the first side 11, through a machined slot 19, to the fullest extent and extends radially outside the frame member 8 from the first side 11, in a plane that is parallel to that of frame member 8, as indicated in FIGS. 2 and 3. The distance between the first key component 15 and the second key component 17 is that which enables the two components to straddle the hinge member 9 in a locational clearance fit.

Figure 5:
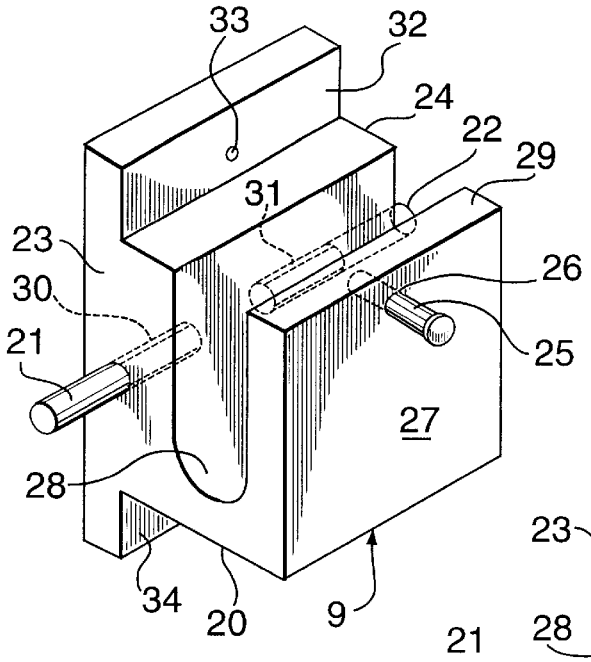
FIG. 5 is an isometric view of the hinge member of the apparatus, according to the first embodiment of the invention, in the frame member receiving mode.

As illustrated in FIG. 5, the hinge member 9 is an assembly of four components:

- a hinge component 20, which supports the frame member 8 in the horizontal and vertical positions, while allowing pivoting movement of that frame member;
- a first cylindrical stop component 21 and a second cylindrical stop component 22, adapted for threaded engagement with the first side 23 and the second side 24 of the hinge component 20, respectively, and which prevent rotation of the frame member 8 below the horizontal plane, when it is engaged with the hinge component 20; and
- a retractable pin component 25, in the form of a clevis pin, designed for sliding engagement with a borehole 26 through the front wall 27 of the hinge component 20. When fully inserted, clevis pin 25 prevents the accidental separation of the frame member 8 from the hinge member 9 during the transition from the operating position, shown in FIG. 6, to the storage position shown in FIG. 7, and vice versa, when the frame member 8 must be raised slightly, in order to engage with, and disengage from, respectively, storage cradle member 10.

Figure 6:
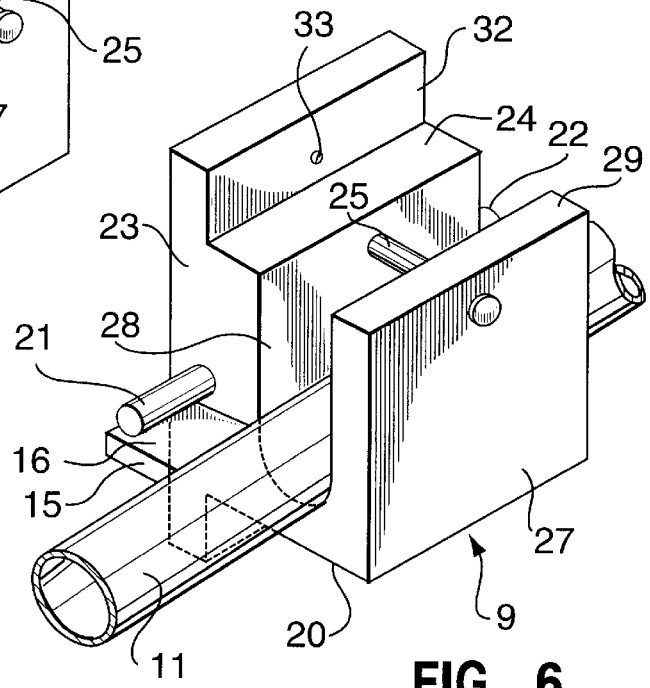
FIG. 6 is an isometric view of the hinge member and the engagement section of the frame member of the apparatus, according to the first embodiment of the invention, when the frame member is in the operational position.
Figure 7:
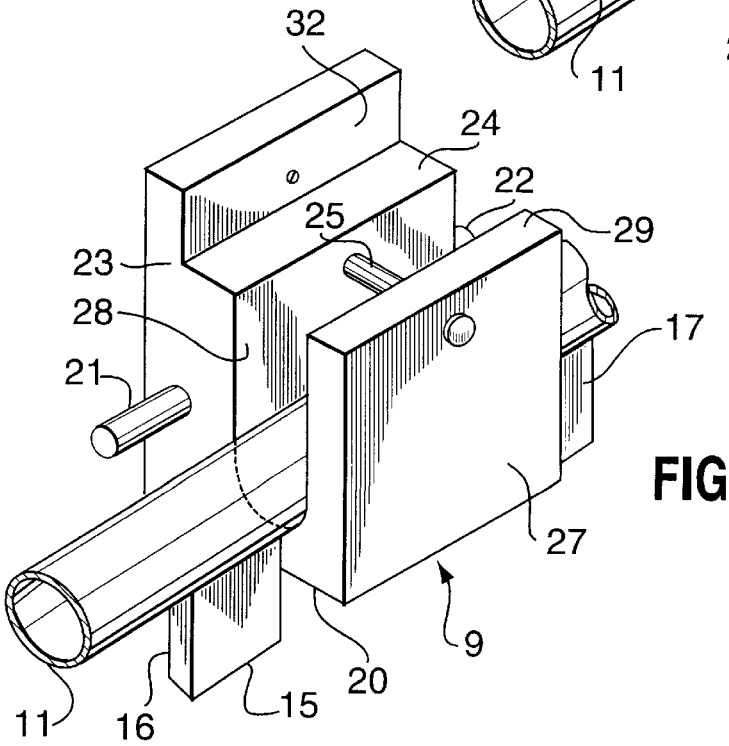
FIG. 7 is an isometric view of the hinge member and the engagement section of the frame member of the apparatus, according to the first embodiment of the invention, when the frame member is in the storage position.

As shown collectively in FIGS. 5, 6 and 7, the hinge component 20 also incorporates

- a deep, horizontal, tube-receiving channel 28, that intersects the upper surface 29 of the forward portion and both sides 23 and 24 of the component, respectively, and is sized to receive first side 11 of frame member 8 in a clearance fit;
- a first, blind, horizontal, stop component-receiving hole 30 and a matching, second receiving hole 31; as well as an upper, rear attachment element 32, containing a borehole 33, and a matching, lower, rear attachment element 34, containing a similar borehole (not shown), through which the hinge member 9 can be fastened to the side wall 2 of the shower-enclosure.

Figure 8:
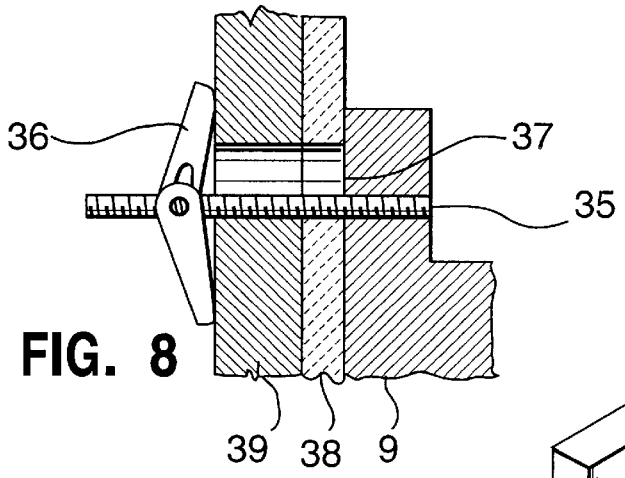
FIG. 8 is a sectional side view of a machine screw and toggle fastener, connecting a hinge or storage cradle member to a wall of hollow construction, comprising tile attached to drywall sheet, secured to wall studs.

The fastener, in each case, as shown in FIG. 8, is a suitably sized machine screw 35 and toggle 36 which can secure the hinge member 9 to the side wall 2 through the borehole and toggle entry hole 37 in the components of that wall. For the purpose of illustration, FIG. 8 presumes tile 38 on top of a drywall panel 39. Should the screw 35 and toggle 36 be inappropriate for the wall composition, however, other suitable fasteners could be employed instead.

Figure 9:
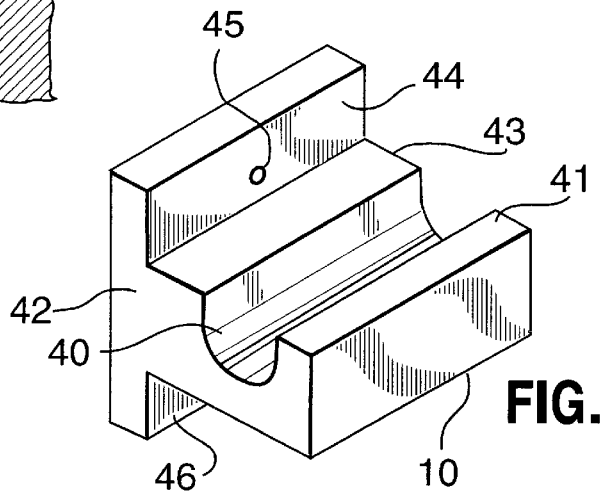
FIG. 9 is an isometric view of the storage cradle member of the apparatus, according to the first embodiment of the invention, in the frame member receiving mode.

Completing the embodiment, as shown generally in FIGS. 1 and 2, and in more detail in FIG. 9, the means for securing the frame member 8 in a vertical storage position, when required, is a storage cradle member 10. As indicated, that member incorporates a relatively shallow, horizontal, tube-receiving channel 40, that intersects the upper surface 41 of the forward portion and both sides 42 and 43 of the member, respectively, and is sized to receive second side 12 of frame member 8 in a clearance fit. An upper, rear attachment element 44, containing a borehole 45 through which the storage cradle member 10 can be fastened to the side wall 2 of the shower-enclosure, and a matching lower, rear attachment element 46, containing a similar borehole (not shown), make up the remainder of the member. In each case, the same type of fastener is employed, as is used for the hinge member 9. As shown in FIGS. 1 and 2, the storage cradle member 10 is fastened to the side wall 2 at a location above the hinge member 9, thus permitting engagement of the storage cradle member 10 with the second side 12 of the frame member 8, while the first side 11 of that member is still engaged with the hinge member 9.

In a second embodiment of the invention, means are also provided for adjustment by the bather of the operational and storage height of the frame member 8 within the shower-enclosure, to facilitate its use by bathers of varying physical height. For that purpose, hinge member 9 and storage cradle member 10 of the first embodiment are modified to eliminate the wall attachment elements of each member and to replace them with vertical grooves in the rear walls of each member and horizontal boreholes which extend from one side of each member to the other.

Figure 10:
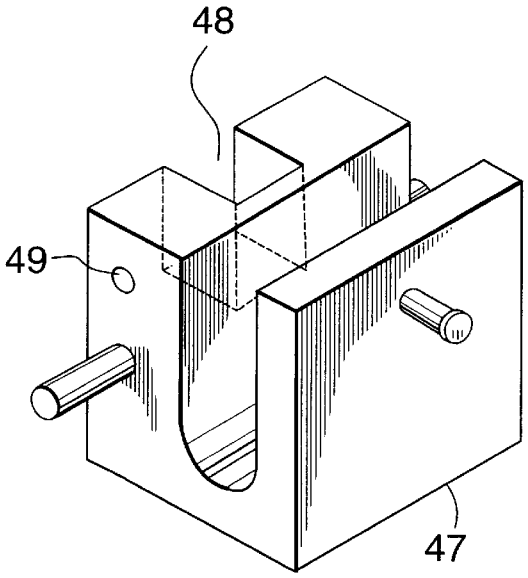
FIG. 10 is an isometric view of the hinge member of the apparatus, according to the second embodiment of the invention, in the frame member receiving mode.
Figure 11:
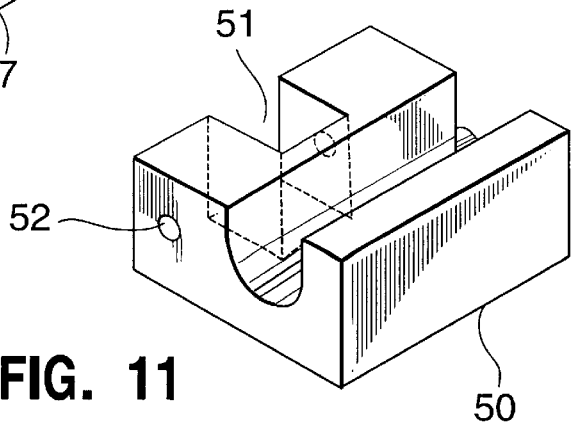
FIG. 11 is an isometric view of the storage cradle member of the apparatus, according to the second embodiment of the invention, in the frame member receiving mode.
Figure 12:
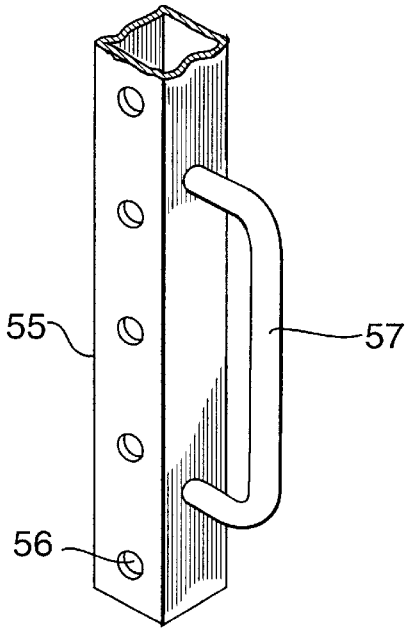
FIG. 12 is an isometric view of the middle section of the upstanding member of the apparatus, according to the second embodiment of the invention.
Figure 15:
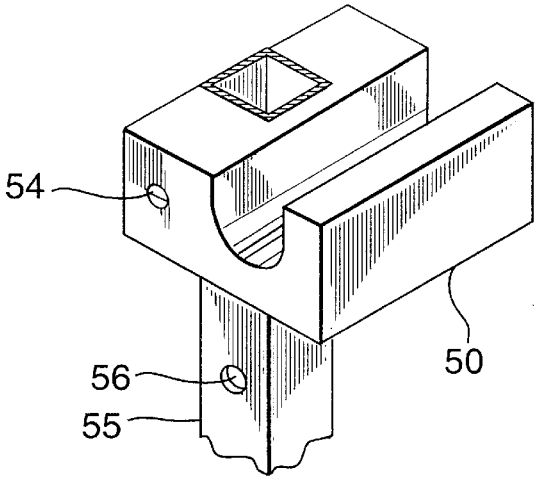
FIG. 15 is an isometric view of the storage cradle member of the apparatus, according to the second embodiment of the invention, connected to the upper end of the upstanding member.

Accordingly, FIG. 10 illustrates a new hinge member 47, having a vertical groove 48 and horizontal borehole 49, and FIG. 11 shows a new storage cradle member 50, having a vertical groove 51 and horizontal borehole 52. Complementing those members are an additional, upstanding member 55, shown partly in FIG. 12, and an additional, guide member 58, shown in FIG. 13. Using the grooves and boreholes provided, hinge member 47 is secured by machine screw 53 and nut (not shown) to the lower end of upstanding member 55, as shown in FIG. 14, and storage cradle member 50 is secured by machine screw 54 and nut (not shown) to its upper end, as shown in FIG. 15. Upstanding member 55 has a length that enables frame member 8 to be securely seated, simultaneously, within the tube-receiving channels of hinge member 47 and storage cradle member 50, respectively, when frame member 8 is in the storage position. It also incorporates a series of evenly-spaced boreholes 56 in one side or two opposite sides, over almost its entire length, as well as a centrally-positioned handle 57 attached to its front surface, as shown in FIG. 12, using machine screws and countersunk boreholes (not shown).

Figure 13:
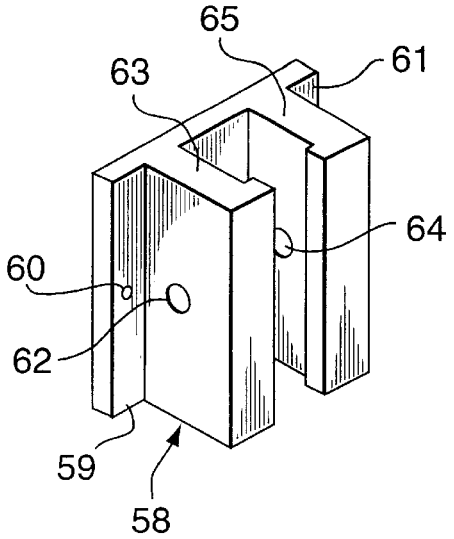
FIG. 13 is an isometric view of the guide member of the apparatus, according to the second embodiment of the invention, in the upstanding member receiving mode.
Figure 14:
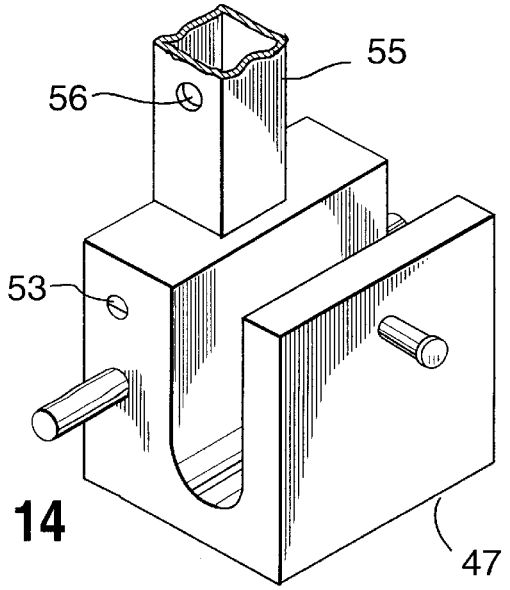
FIG. 14 is an isometric view of the hinge member of the apparatus, according to the second embodiment of the invention, connected to the lower end of the upstanding member.
Figure 16:
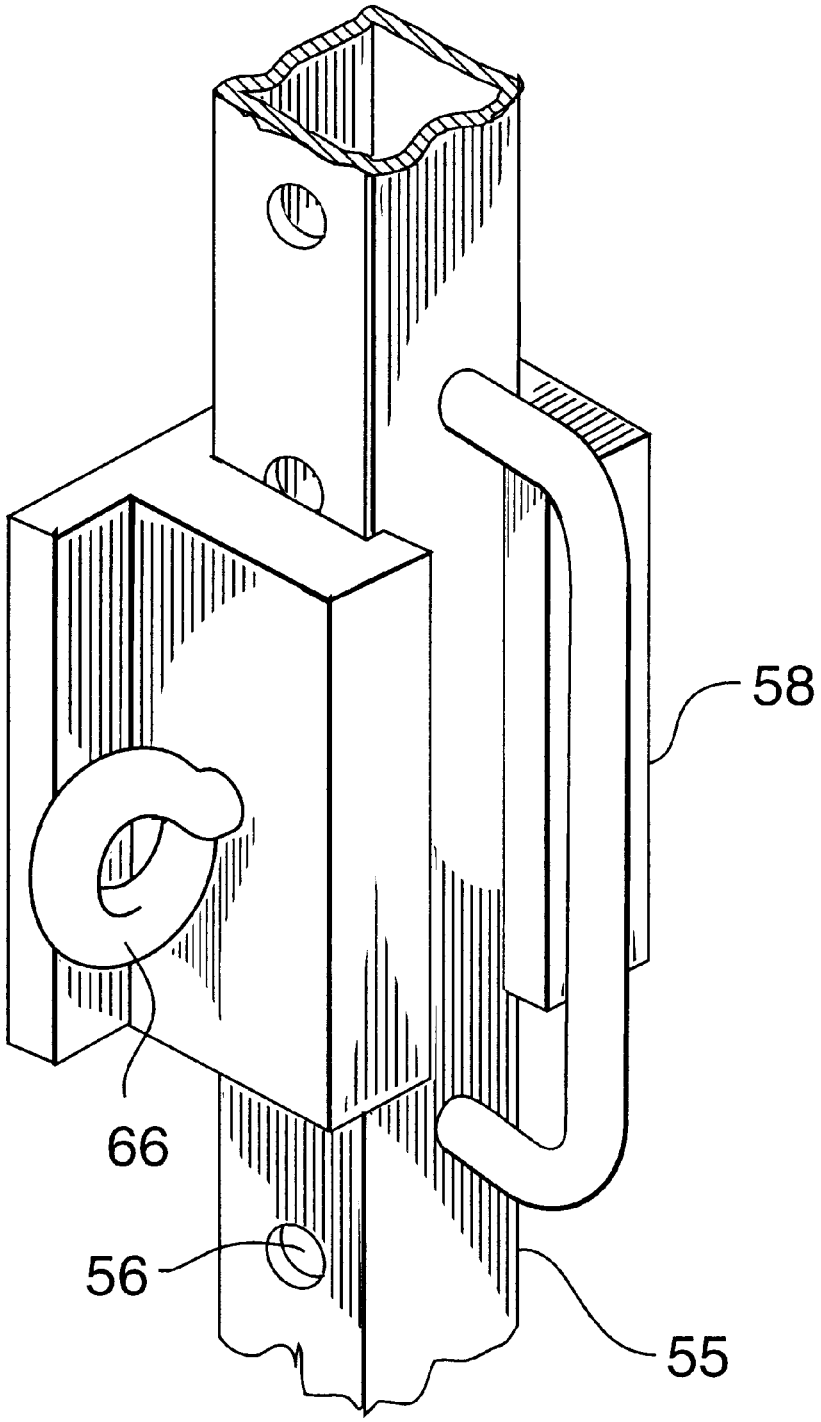
FIG. 16 is an isometric view of the central portion of the height adjustment means of the apparatus, according to the second embodiment of the invention, showing the upstanding member fixed within the guide member by the retractable stop pin.
Figure 17:
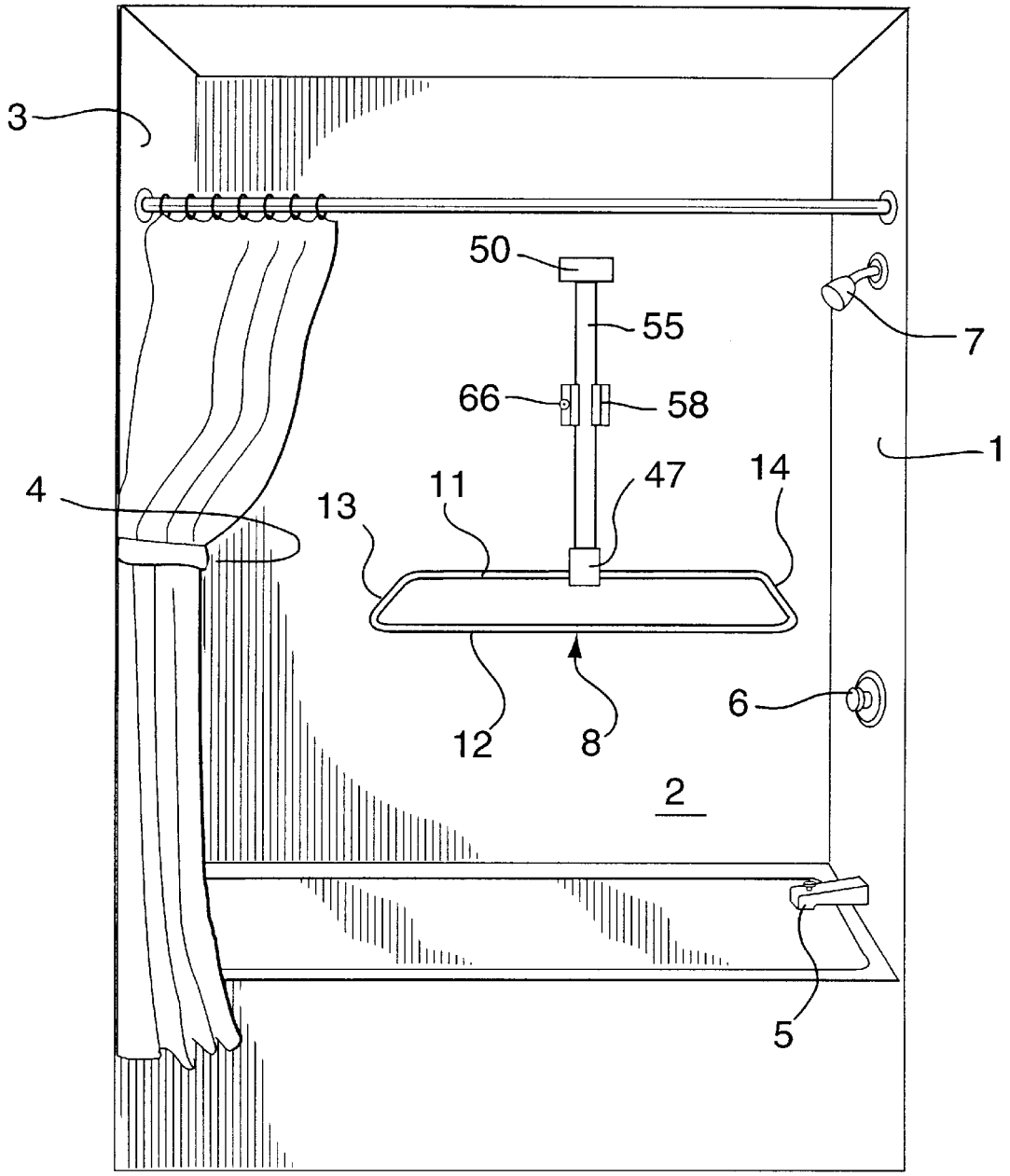
FIG. 17 is a perspective view of the apparatus, according to the second embodiment of the invention, displayed in the operational position, in a bathtub-shower combination unit.

Completing the second embodiment of the invention, is the vertically-mounted guide member 58 shown in FIG. 13, which has a first wall-attachment element 59 and borehole 60, and a second wall-attachment element 61 and borehole (not shown), through which it can be secured to the side wall 2 of the shower-enclosure, using machine screws and toggles or other appropriate fasteners. Guide member 58, which is sized to receive upstanding member 55 in a sliding fit, also incorporates a centrally-positioned borehole 62 in its first side wall 63, and/or a similar borehole 64 in its second side wall 65, through which a stop means, such as a straight or tapered pin 66, with a head suitable for grasping, shown in FIGS. 16 and 17, can be inserted to penetrate a selected borehole 56 in upstanding member 55. By choosing an appropriate borehole 56 in upstanding member 55 and aligning it with borehole 62 or 64 of guide member 58, therefore, the height of the apparatus in general, and frame member 8 in particular, can be adjusted and fixed within the shower-enclosure, using pin 66. It will be understood, however, that other means of height adjustment of the apparatus are intended to be within the scope of the invention.

In the third embodiment of the invention, the generally rectangular shape of frame member 8 and the length of upstanding member 55 are altered to conform with the shape and dimensions of an irregularly shaped, corner, shower stall. At the same time, the radial key components of the frame member are re-positioned, off-center, on one of its longest sides, so that an opposite, parallel side can engage, when required, with the storage cradle member 50, situated vertically above hinge member 47 of the apparatus.

Figure 18:
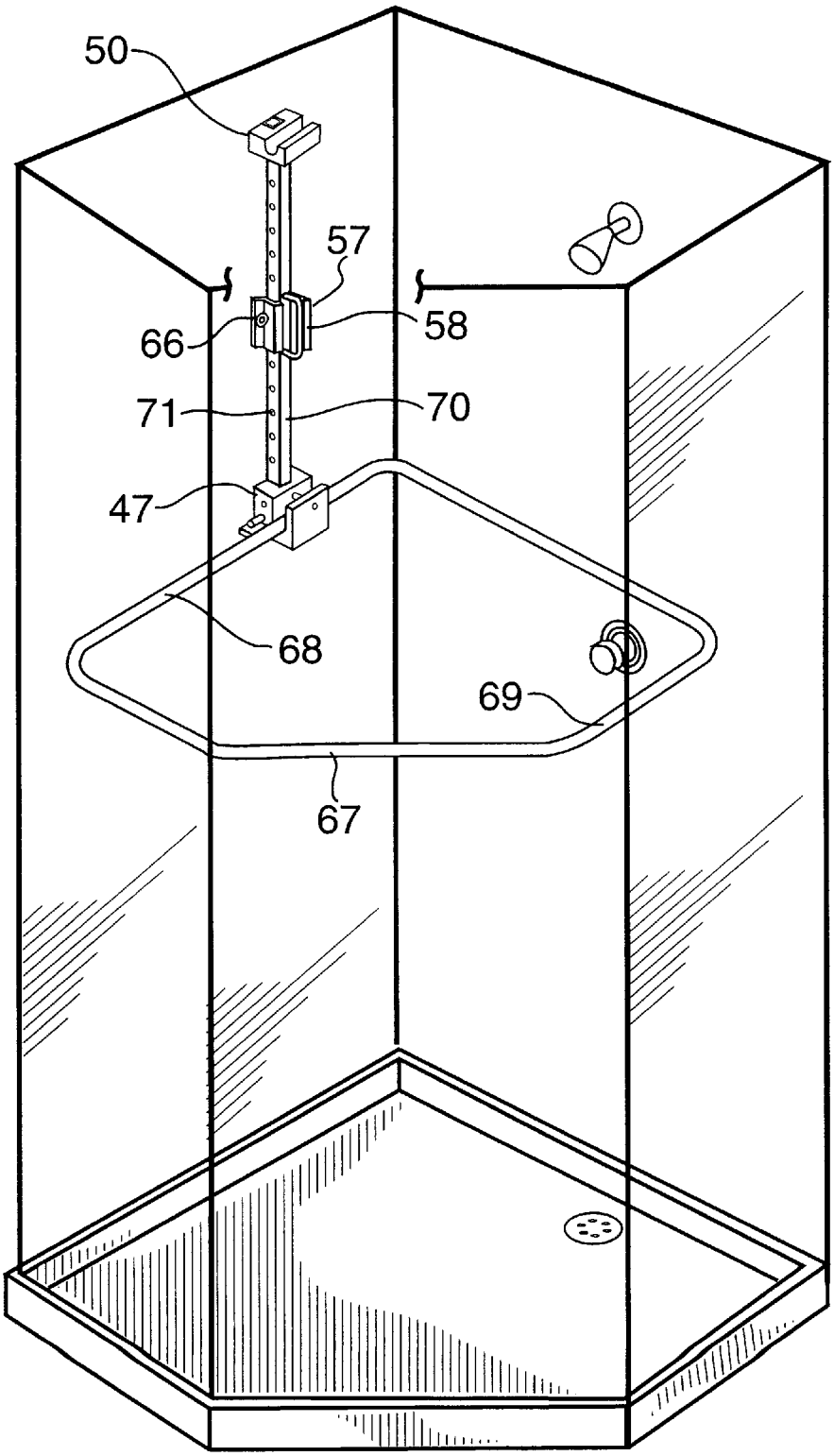
FIG. 18 is an isometric view of the-apparatus, according to the third embodiment of the invention, displayed in the operational position, in a corner shower stall.

Accordingly, FIG. 18 illustrates a new frame member 67, having a first side 68 and an opposite, parallel, second side 69, as well as a new upstanding member 70, having a length that enables frame member 67 to be securely seated, at the same time, within the tube-receiving channels of hinge member 47 and storage cradle member 50, respectively, when frame member 67 is in the storage position. As in the second embodiment, upstanding member 70 incorporates a series of evenly-spaced boreholes 71 in one side or two opposite sides, over almost its entire length, as well as the centrally-positioned handle 57 attached to its front surface.

Engagement of the frame member with the hinge and storage cradle members, in all embodiments, is carried out as follows:

(1) the retractable pin component 25 of hinge member 9 or 47 is withdrawn to the extent required to leave the tube-receiving channel 28 clear;

(2) the first side 11 or 68 of frame member 8 or 67, respectively, is inserted into the tube-receiving channel 28 of hinge member 9, and into the counterpart of hinge member 47, with the radial keys 15 and 17 of frame member 8 and their counterparts in frame member 67, pointing downward;

(3) the frame member is lifted marginally from the bottom of the channel and then rotated to the vertical position, so that its second side can be positioned marginally above the storage cradle member 10 or 50;

(4) the frame member is lowered, so that its first side is seated in the tube-receiving channel of the hinge member and its second side in the tube-receiving channel of the storage cradle member;

(5) the retractable pin component is inserted into the hinge member to the maximum extent, so that it protrudes into the tube-receiving channel and serves to prevent accidental removal of the frame member from the hinge member.

When use of the frame member is required, the bather lifts the frame member marginally, to clear the storage cradle member, and rotates the frame member over his or her head to the horizontal position, when the keys of the first side come into contact with the undersides of the cylindrical stop components 21 and 22 of hinge member 9 or their counterparts in hinge member 47 and the frame member is prevented from rotating further. In that position, the frame member can surround the bather and offer protection in all directions within the plane of that member. To return the frame member to the storage position, it is rotated upward, lifted sufficiently to clear the storage cradle member and then lowered so that it is firmly seated in the channels of both members, when it provides a stable support for the bather to use upon leaving the shower-enclosure.

To establish the feasibility and utility of the invention, the apparatus has been constructed principally from aluminum and wood components, with the intention of replacing the wood by either aluminum, plastic, ceramic or some appropriate composite material for commercial scale production. As a result, aluminum tube of circular cross-section has been used for the frame member, aluminum bar stock for the radial keys, aluminum tube of square cross-section for the upstanding member, wood for the hinge, storage cradle and guide members, and steel for the stop components, pins and fasteners. In addition, the frame member has been formed, using the Rotary Draw Bending Process to minimize tube deformation, and welding of the tube ends has been employed to complete the frame. Welding has also been used to secure the radial keys within the frame tube. Those choices, however, are not intended to be limiting and any changes in materials, components, methods of construction or design of the apparatus, that might be introduced for commercial reasons, are considered to be within the scope of the invention. For example, such changes might include replacing the flat keys of the frame member with round, functionally equivalent, tubular components, or mounting the guide member through two countersunk holes, centered one above the other in its rear wall, instead of as shown, to permit it to be fastened to a narrower wall stud, using wood screws.

In conclusion, it has been demonstrated that the present invention can be constructed to achieve all of the objects set out previously. Most important, however, the invention provides a device which overcomes the disadvantages of conventional grab-bar installations, as a source of hand support during the showering process, by closing the protection gap associated with such installations and offering protection to a showering bather in all directions within a horizontal plane, as well as upon entering and leaving the shower-enclosure. In addition, it provides a device which can be employed at the bather's option, which is safe and reliable to use, which is easy to operate and adjust, which is easy to install and which is adaptable to users of varying physical height. It should also be understood that there is no intent to restrict the use and application of the invention to adults and the home. Clearly, the described features could encourage parents to consider a supplementary apparatus for specific use by growing children. At the same time, applications in other settings, such as hotels, motels, lodges, retirement residences, nursing homes and hospitals, college and university living quarters etc. are readily apparent and are within the scope of the invention. In totality, therefore, the invention satisfies a long-standing and continuing need among the population at large and senior citizens, the handicapped, and pregnant women, in particular, for greater safety and convenience during the showering activity, which is not being met by the prior art.

The embodiments of the invention in which an exclusive property or privilege is claimed, are defined as follows:

1. A support apparatus for use in a shower enclosure to provide optional hand support for a bather in said shower enclosure, said apparatus comprising:

a single-piece support member constructed so as to be selectively moveable between a first position for storage in a vertical plane during non-use, to a second position for surrounding in spaced fashion the bather in a horizontal plane;

a hinge member releasably mountable to a wall of said shower enclosure, said hinge member comprising a tube receiving groove adapted to receive said support member and to permit movement of said support member from said first position to said second position and a releasable locking means to selectively hold said support member within said hinge member in either of said first or second position; and a stop means to prevent movement of said support member away from said vertical plane beyond said horizontal plane, said stop means comprising at least one horizontal projection on said support member toward said wall when said support member is in said second position and at least one abutment means on said hinge member constructed so that said projection abuts said abutment means on a surface thereof that is substantially parallel with said horizontal plane when said support member is in said second position.

2. The support apparatus of claim 1 further comprising a support cradle member releasably mountable to said wall of said shower enclosure in a position vertically remote from said hinge member, said storage cradle member comprising a tube receiving groove adapted to receive said support member.

3. The support apparatus of claim 1 further comprising a height adjustment means comprising a vertically upstanding member having a bottom end and a top end, wherein said hinge member is releasably secured to said bottom end and said support cradle member is releasably secured to said top end; and a guide member attachable to said wall having a track slidably to receive said vertically upstanding member, wherein said vertically upstanding member is selectively moveable and lockable within said track among a plurality of vertical positions.

4. The support apparatus of claim 1 wherein said single-piece support member comprises a tubular member sized so as to surround without contacting the bather.

5. The support apparatus of claim 1 wherein said single-piece support member is shaped the same as said shower enclosure.

6. The support apparatus of claim 1 wherein said locking means comprises a pin constructed so as to selectively allow movement of said support member in and out of said tube receiving groove.

7. A support apparatus for use in a shower enclosure to provide optional hand support for a bather in said shower enclosure, said apparatus comprising:

a single-piece support member constructed so as to be selectively moveable between a first position for storage in a vertical plane during non-use, to a second position for surrounding in spaced fashion the bather in a horizontal plane;

a hinge member releasably mountable to a wall of said shower enclosure, said hinge member comprising a tube receiving groove adapted to receive said support member and to permit movement of said support member from said first position to said second position and a releasable locking means to selectively hold said support member within said hinge member in either of said first or second position;

a stop means to prevent movement of said support member away from said vertical plane beyond said horizontal plane;

a height adjustment means comprising a vertically upstanding member having a bottom end and a top end, wherein said hinge member is releasably secured to said bottom end; and a guide member attachable to said wall having a track to receive said vertically upstanding member, wherein said vertically upstanding member is selectively moveable and lockable within said track among a plurality of vertical positions.

8. A support apparatus for use in a shower enclosure to provide optional hand support for a bather in said shower enclosure, said apparatus comprising:

a single-piece support member comprising an integral tubular member selectively moveable between a first position for storage in a vertical plane during non-use and a second position for surrounding the bather in a horizontal plane, said tubular member shaped to contour the bathing area and sized so as to surround without contacting the bather when in use in said horizontal plane;

a hinge member releasably mountable to a wall of said shower enclosure, said hinge member comprising a tube receiving groove adapted to receive said support member and to permit movement of said support member from said first position to said second position and a releasable locking means to selectively hold said support member within said hinge member;

a stop means to prevent movement of said support member beyond said horizontal plane;

a support cradle member releasably mountable to said wall of said shower enclosure in a position vertically remote from said hinge member, said storage cradle member comprising a tube receiving groove adapted to receive said support member; and a height adjustment means comprising a vertically upstanding member having a bottom end and a top end, wherein said hinge member is releasably secured to said bottom end and said support cradle member is releasably secured to said top end; and a guide member attachable to said wall having a track to receive said vertically upstanding member, wherein said vertically upstanding member is selectively moveable and lockable within said track among a plurality of vertical positions.

9. The support apparatus of claim 8 wherein said support member is shaped the same as said shower enclosure.

* * * * *